US006244696B1

(12) United States Patent
Tran et al.

(10) Patent No.: US 6,244,696 B1
(45) Date of Patent: Jun. 12, 2001

(54) INKJET PRINT CARTRIDGE DESIGN FOR DECREASING INK SHORTS BY USING AN ELEVATED SUBSTRATE SUPPORT SURFACE TO INCREASE ADHESIVE SEALING OF THE PRINTHEAD FROM INK PENETRATION

(75) Inventors: Hai Q Tran; Steven W Steinfield; Ali Emamjomeh, all of San Diego; Joseph E Scheffelin, Poway, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/303,246

(22) Filed: Apr. 30, 1999

(51) Int. Cl.[7] ..... B41J 2/175
(52) U.S. Cl. ..... 347/87
(58) Field of Search ..... 347/85, 86, 87, 347/44, 47, 65, 20

(56) References Cited

U.S. PATENT DOCUMENTS

| | | | |
|---|---|---|---|
| 5,278,584 | 1/1994 | Keefe et al. | 347/63 |
| 5,291,226 | 3/1994 | Schantz et al. | 347/63 |
| 5,442,384 | 8/1995 | Schantz et al. | 347/20 |
| 5,442,386 | 8/1995 | Childers et al. | 347/50 |
| 5,450,113 | 9/1995 | Childers et al. | 347/87 |
| 5,736,998 | 4/1998 | Caren et al. | 347/45 |
| 5,815,185 * | 9/1998 | Pietrzyk | 347/92 |
| 5,852,460 | 12/1998 | Schaeffer et al. | 347/87 |

* cited by examiner

*Primary Examiner*—N. Le
*Assistant Examiner*—Michael Nghiem
(74) *Attorney, Agent, or Firm*—Dennis G. Stenstrom

(57) ABSTRACT

Disclosed is a flexible circuit that has a nozzle member formed therein with the nozzle member including a plurality of ink orifices and the flexible circuit having electrical leads. A substrate containing a plurality of heating elements and associated ink ejection chambers and having electrodes to which the electrical leads are bonded is mounted on a back surface of the nozzle member. Each heating element is located proximate to an associated ink orifice with the back surface of the nozzle member extending over two or more outer edges of the substrate. A print cartridge body having a headland portion is located proximate to the back surface of the nozzle member and includes an inner raised wall circumscribing the substrate with an adhesive support surface formed thereon and having wall openings therein. The wall openings have an adhesive support surface and an elevated substrate support surface raised above the adhesive support surface for supporting the substrate. An adhesive layer is located between the back surface of the nozzle member and the headland to affix the nozzle member to the headland. The adhesive layer located on the adhesive support surface of the inner raised wall and along the adhesive support surface within the wall openings therein and on the elevated substrate support surface, so as to encapsulate the ends of the substrate.

15 Claims, 11 Drawing Sheets

INKJET PRINT CARTRIDGE DESIGN FOR DECREASING INK SHORTS BY USING AN ELEVATED SUBSTRATE SUPPORT SURFACE TO INCREASE ADHESIVE SEALING OF THE PRINTHEAD FROM INK PENETRATION

CROSS-REFERENCE TO RELATED APPLICATIONS

This application relates to the subject matter disclosed in the following U.S. patent application and U.S. patents:

- U.S. patent application Ser. No. 09/302,837, filed concurrently herewith, entitled "Inkjet Print Cartridge Design to Decrease Ink Shorts Due to Ink Penetration of the Printhead;
- U.S. Pat. No. 5,852,460, entitled "Inkjet Print Cartridge Design to Decrease Deformation of the Printhead When Adhesively Sealing The Printhead to the Print Cartridge;"
- U.S. Pat. No. 5,736,998, entitled "Inkjet Cartridge Design for Facilitating the Adhesive Sealing of a Printhead to an Ink Reservoir;"
- U.S. Pat. No. 5,450,113, entitled "Adhesive Seal for an Inkjet Printhead;"
- U.S. Pat. No. 5,442,384, entitled "Integrated Nozzle Member and TAB Circuit for Inkjet Printhead;"
- U.S. Pat. No. 5,278,584 to Keefe, et al., entitled "Ink Delivery System for an Inkjet Printhead;" and
- U.S. Pat. No. 5,291,226, entitled "Nozzle Member Including Ink Flow Channels."

The above patents are assigned to the present assignee and are incorporated herein by reference.

FIELD OF THE INVENTION

The present invention generally relates to inkjet printers and, more particularly, to the printhead portion of an inkjet print cartridge.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

In U.S. Pat. No. 5,442,384, entitled "Integrated Nozzle Member and TAB Circuit for Inkjet Printhead," a novel nozzle member for an inkjet print cartridge and method of forming the nozzle member are disclosed. A flexible circuit tape having conductive traces formed thereon has formed in it nozzles or orifices by Excimer laser ablation. The resulting flexible circuit having orifices and conductive traces may then have mounted on it a substrate containing heating elements associated with each of the orifices. The conductive traces formed on the back surface of the flexible circuit are then connected to the electrodes on the substrate and provide energization signals for the heating elements. A barrier layer, which may be a separate layer or formed in the nozzle member itself, includes vaporization chambers, surrounding each orifice, and ink flow channels which provide fluid communication between a ink reservoir and the vaporization chambers.

In U.S. Pat. No. 5,648,805, entitled "Adhesive Seal for an Inkjet Printhead," a procedure for sealing an integrated nozzle and flexible or tape circuit to a print cartridge is disclosed. A nozzle member containing an array of orifices has a substrate, having heater elements formed thereon, affixed to a back surface of the flexible circuit. Each orifice in the flexible circuit is associated with a single heating element formed on the substrate. The back surface of the flexible circuit extends beyond the outer edges of the substrate. Ink is supplied from an ink reservoir to the orifices by a fluid channel within a barrier layer between the flexible circuit and the substrate. In either embodiment, the flexible circuit is adhesively sealed with respect to the print cartridge body by forming an ink seal, circumscribing the substrate, between the back surface of the flexible circuit and the body. This method and structure of providing a seal directly between a flexible circuit and an ink reservoir body has many advantages.

However, during manufacturing, the headland design of previous print cartridges had several disadvantages, including difficulty in controlling the edge seal to the die or substrate without having adhesive getting into the nozzle and clogging them, or on the other hand, voids of adhesive in the flexible circuit bond window. It was also very difficult to control the adhesive bulge through the window caused by excess adhesive, or varying die placement. All of these problems result in extremely high yield losses when manufacturing thermal inkjet print cartridges.

U.S. Pat. No. 5,736,998, entitled "Inkjet Cartridge Design for Facilitating the Adhesive Sealing of a Printhead to an Ink Reservoir," and U.S. Pat. No. 5,852,460, entitled "Inkjet Print Cartridge Design to Decrease Deformation of the Printhead When Adhesively Sealing The Printhead to the Print Cartridge;" improved headland designs are disclosed which alleviate some of the above-mentioned problems.

However, these designs did not address the problem of ink shorts caused by ink leaking into the conductive leads and conductive traces of the flexible circuit. Flexible circuit leads are bonded to pads or electrodes on the outer edges of the substrate. To enable this bonding, a window is created in the flexible circuit to allow a bonder thermode to apply force and temperature to the flexible circuit leads that are resting on the bond pads. After the leads have been bonded, an encapsulant is dispensed across the window to protect the exposed bond pad region from intrusion of ink or contamination.

On most flexible circuits these leads are also protected on the back side by a laminated cover layer. In addition, the leads are further protected by the structural adhesive that is used to adhere the flexible circuit to the print cartridge body. However, there are a number of disadvantages to this approach. First, there is a region at both ends of the substrate where the flexible circuit traces may not be protected by the cover layer. In this region, the traces are only protected by the structural adhesive and are therefore susceptible to corrosion and electrical shorting if ink penetrates the structural adhesive to flexible tape interface. This penetration of ink is increased due to the fact that the flexible tape to structural interface may provide a wicking surface for the ink if delamination of the flexible tape occurs. This can lead to corrosion and electrical shorting behind the substrate. Second, air pockets may be created on the underside of the flexible tape near the ends of the substrate when the structural adhesive does not squish uniformly against the flexible circuit during attachment of the flexible circuit to the print cartridge body. These air pockets can provide a path for ink to the flexible circuit traces or the bond pad region and thus lead to corrosion and electrical shorting of the leads or traces.

Previous solutions to the ink shorts problem have focused on (1) improving the chemical and mechanical robustness of the adhesive materials and interfaces and (2) modifying the design on top of the substrate, the layout and geometry of the thin film, thick film and the TAB bond window opening. While considerable gains have been made in both of these areas, they are limited in their effectiveness and additional robustness margin is desired.

Accordingly, there is a need for an improved method of encapsulating the flexible circuit leads that reduces ink shorts and corrosion due to ink penetration into the flexible circuit leads.

SUMMARY OF THE INVENTION

In a preferred embodiment, a flexible circuit has a nozzle member formed therein with the nozzle member including a plurality of ink orifices and the flexible circuit having electrical leads. A substrate containing a plurality of heating elements and associated ink ejection chambers and having electrodes to which the electrical leads are bonded is mounted on a back surface of the nozzle member. Each heating element is located proximate to an associated ink orifice with the back surface of the nozzle member extending over two or more outer edges of the substrate. A print cartridge body having a headland portion is located proximate to the back surface of the nozzle member and includes an inner raised wall circumscribing the substrate with an adhesive support surface formed thereon and having wall openings therein. The wall openings have an adhesive support surface and an elevated substrate support surface raised above the adhesive support surface for supporting the substrate. An adhesive layer is located between the back surface of the nozzle member and the headland to affix the nozzle member to the headland. The adhesive layer located on the adhesive support surface of the inner raised wall and along the adhesive support surface within the wall openings therein and on the elevated substrate support surface, so as to encapsulate the ends of the substrate.

The invention further includes a method of affixing a flexible circuit to an inkjet print cartridge body including providing a flexible circuit having a nozzle member formed therein with a plurality of ink orifices and the with the flexible circuit having electrical leads. The flexible circuit has a substrate mounted on a back surface of the nozzle member. The substrate has a plurality of heating elements and associated ink ejection chambers and electrodes to which the electrical leads are bonded. Each heating element is located proximate to an associated ink orifice and the back surface of the nozzle member extends over two or more outer edges of the substrate. Providing a print cartridge body having a headland portion located proximate to the back surface of the nozzle member and including an inner raised wall circumscribing the substrate. The inner raised wall has an adhesive support surface formed thereon and wall openings therein. The wall openings have an adhesive support surface and an elevated substrate support surface raised above the adhesive support surface for supporting the substrate. Dispensing an adhesive layer between the back surface of the nozzle member and the headland to affix the nozzle member to the headland. The adhesive layer is located on the adhesive support surface of the inner raised wall, along the adhesive support surface within the wall openings therein and on the elevated substrate support surface. Positioning the back surface of the nozzle member with respect to the headland such that the adhesive circumscribes the substrate and affixes the back surface of the nozzle member to the headland so as to encapsulate the ends of the substrate with adhesive.

DETAILED DESCRIPTION OF THE PREFERRED EMBODIMENTS

Figure 1:
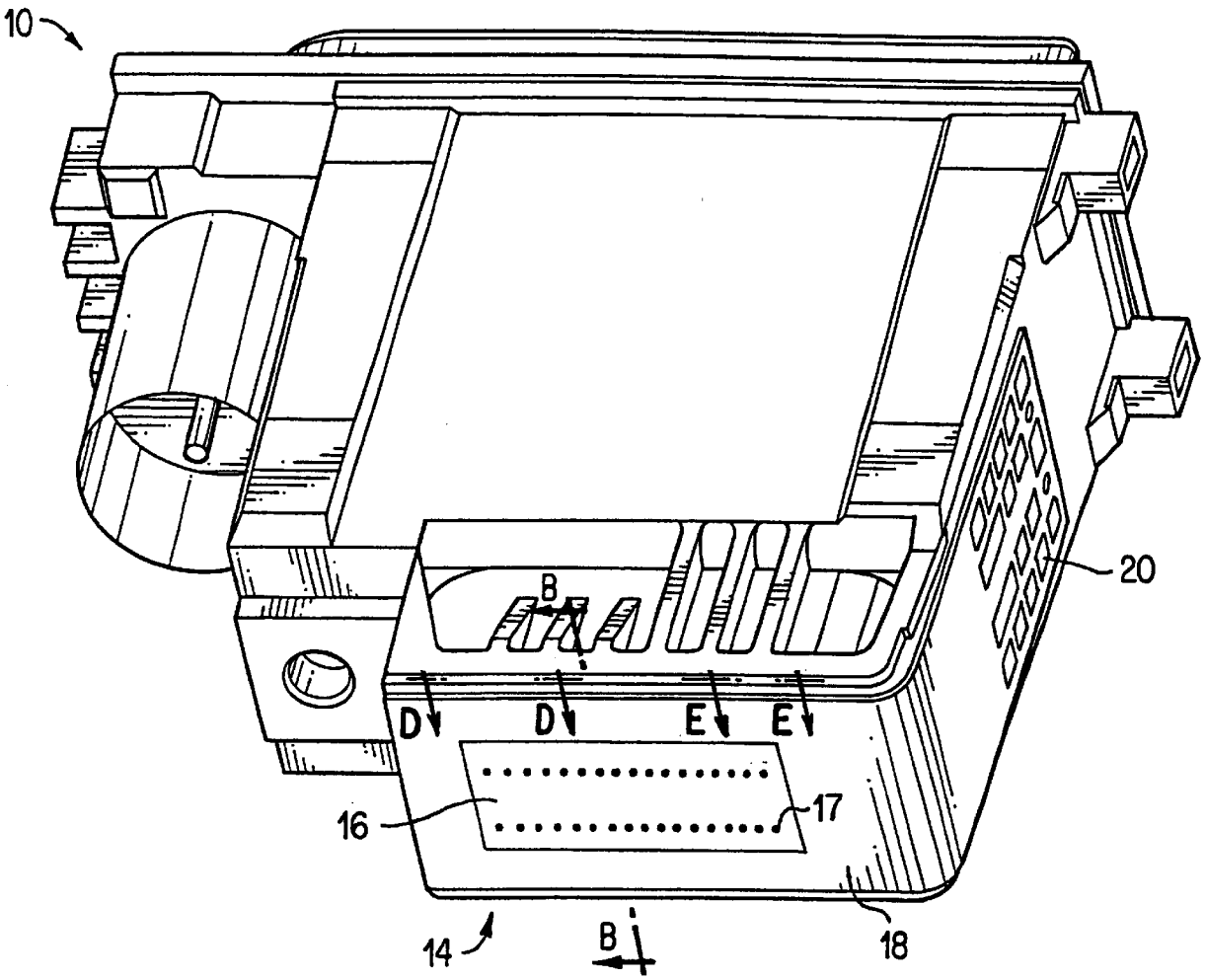
FIG. 1 is a perspective view of an inkjet print cartridge according to one embodiment of the present invention.

Referring to FIG. 1, reference numeral 10 generally indicates an inkjet print cartridge incorporating a printhead according to one embodiment of the present invention. The inkjet print cartridge 10 includes an internal ink reservoir (not shown) and a printhead 14, where the printhead 14 is formed using Tape Automated Bonding (TAB). The printhead 14 (hereinafter "TAB head assembly 14") includes a nozzle member 16 comprising two parallel columns of offset holes or orifices 17 formed in a flexible polymer flexible circuit 18 by, for example, laser ablation. The flexible circuit 18 provides for the routing of conductive traces 36 which are connected at one end to electrodes on a substrate (described below) and on the other end to contact pads 20. The print cartridge 10 is designed to be installed in a printer so that the contact pads 20 on the front surface of the flexible circuit 18, contact printer electrodes providing externally generated energization signals to the printhead.

Figure 2A:
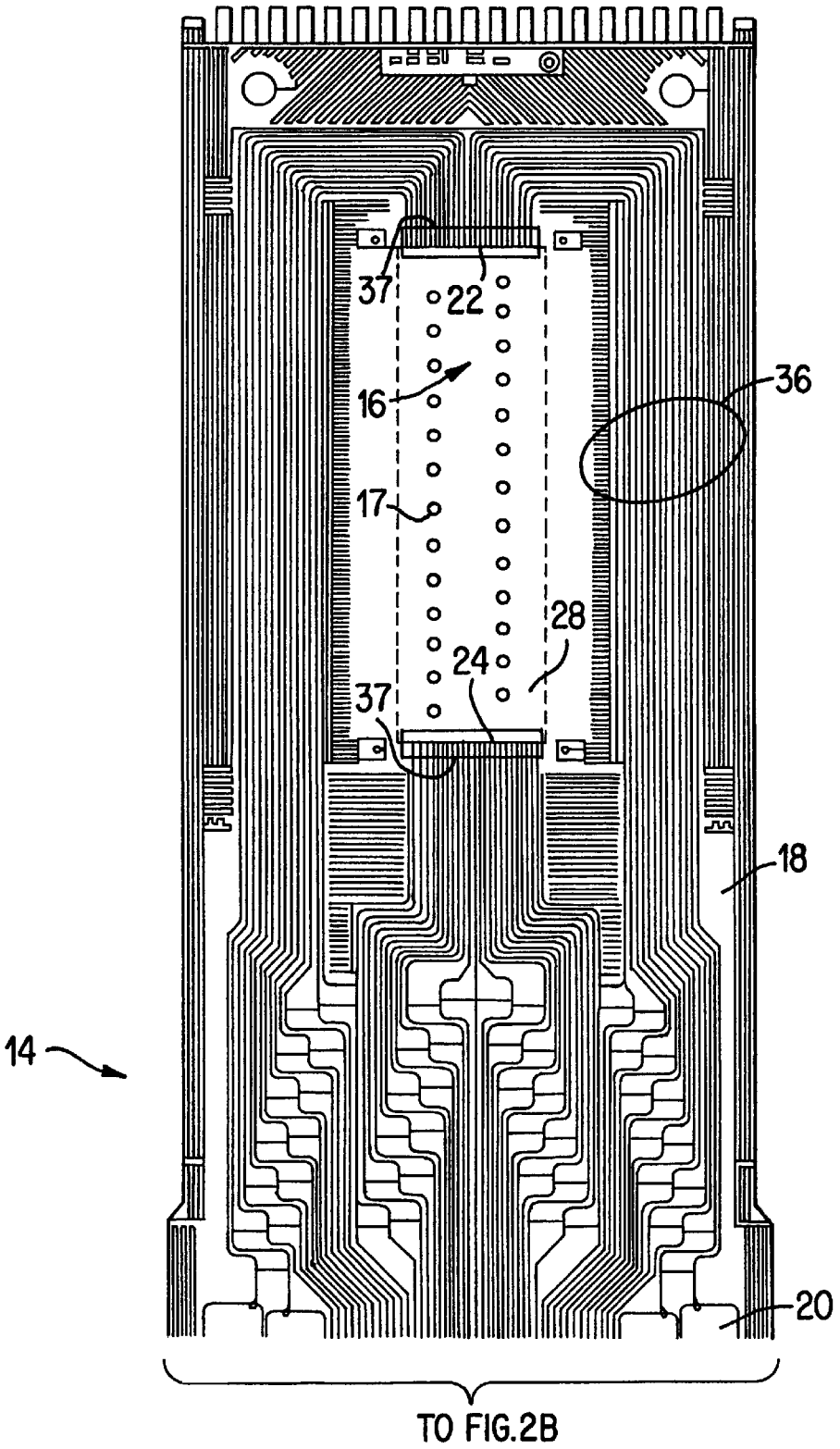
FIG. 2 is a plan view of the front surface of a Tape Automated Bonding (TAB) printhead assembly (hereinafter "TAB head assembly") removed from a print cartridge.
Figure 2B:
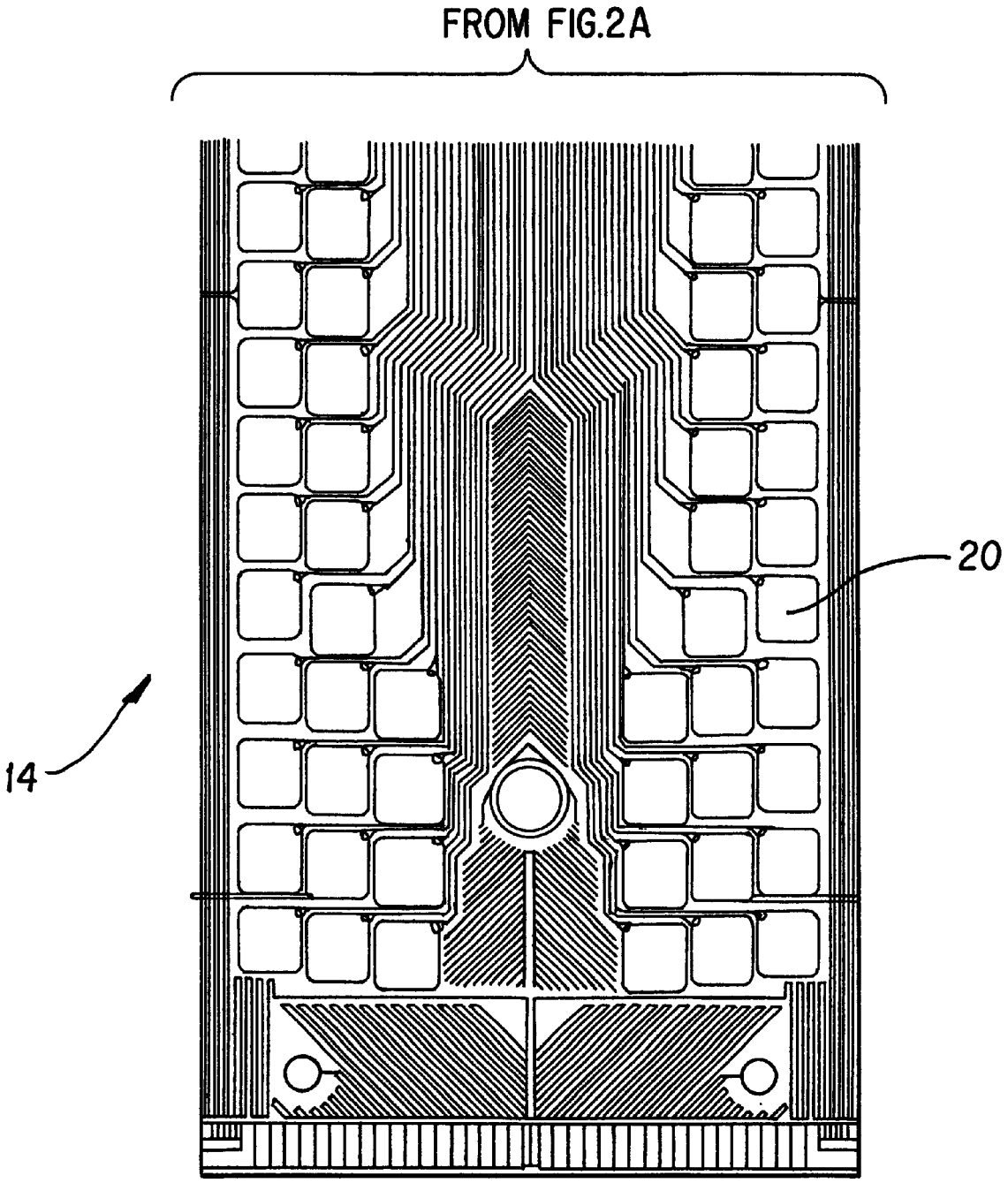

FIG. 2 shows a front view of a TAB head assembly 14 removed from a print cartridge 10. TAB head assembly 14 has affixed to the back of the flexible circuit 18 a silicon substrate 28 (not shown) containing a plurality of individually energizable thin film resistors. Each resistor is located generally behind a single orifice 17 and acts as an ohmic heater when selectively energized by one or more pulses applied sequentially or simultaneously to one or more of the contact pads 20. Windows 22 and 24 extend through the flexible circuit 18 and are used to facilitate bonding of the other ends of the conductive traces 36 to electrodes on the silicon substrate.

The orifices 17 and conductive traces 36 may be of any size, number, and pattern, and the various figures are designed to simply and clearly show the features of the invention. The relative dimensions of the various features have been greatly adjusted for the sake of clarity.

Figure 3:
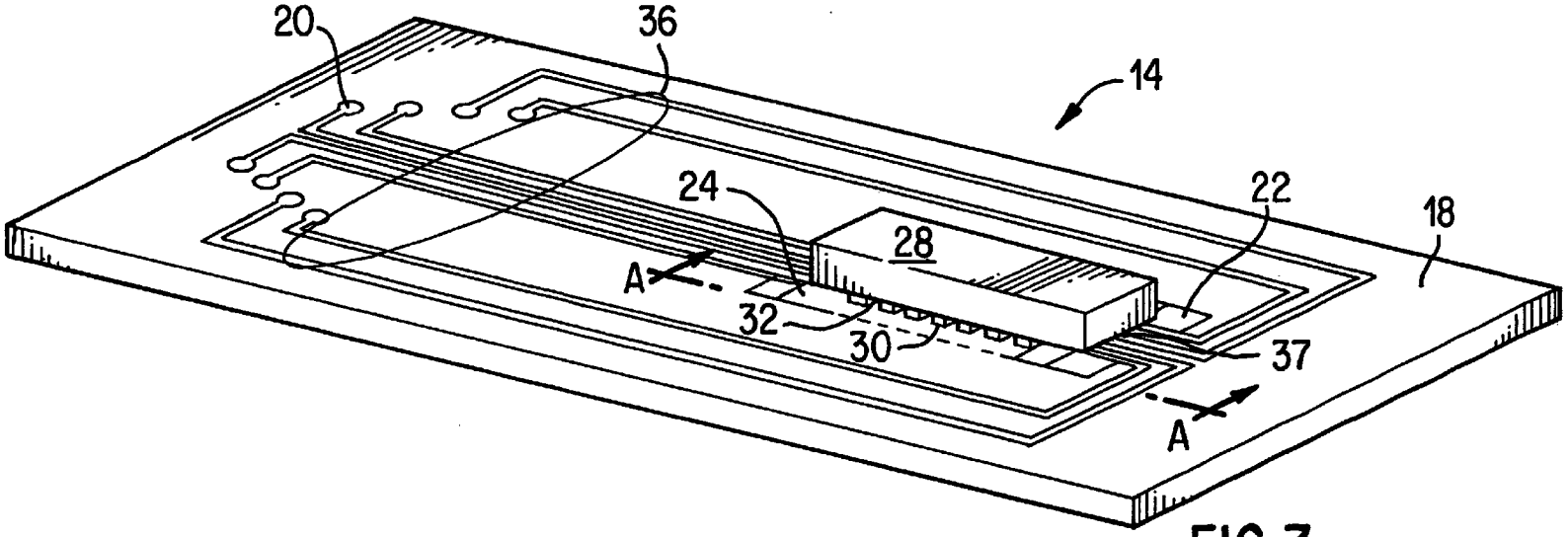
FIG. 3 is a highly simplified perspective view of the back surface of the TAB head assembly of FIG. 2 with a silicon substrate mounted thereon and the conductive leads attached to the substrate.

FIG. 3 shows a highly simplified view of the back surface of a Tape Automated Bonding (TAB) printhead assembly 14 (hereinafter "TAB head assembly"). The back surface of the flexible circuit 18 includes conductive traces 36 formed thereon using a conventional photolithographic etching and/or plating process. The silicon die or substrate 28 is mounted to the back of the flexible circuit 18 with the nozzles or orifices 17 aligned with an ink vaporization chamber 32. The conductive traces 36 are terminated by leads 37 that are bonded to electrodes 40 on the substrate 28 and by contact pads 20 designed to interconnect with a printer. Also shown is one edge of the barrier layer 30 containing vaporization chambers 32 formed on the substrate 28. Shown along the edge of the barrier layer 30 are the entrances to the vaporization chambers 32 which receive ink from an internal ink reservoir within the print cartridge 10. The windows 22 and 24 allow access to the leads of the conductive traces 36 and the substrate electrodes 40 (shown in FIG. 4) to facilitate bonding of the leads to the electrodes.

Figure 4:
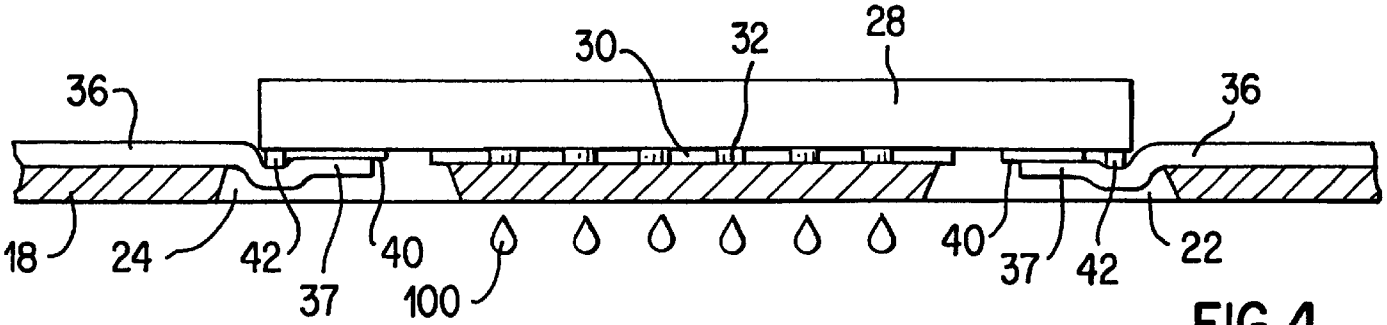
FIG. 4 is a side elevational view in cross-section taken along line A—A in FIG. 3 illustrating the attachment of conductive leads to electrodes on the silicon substrate.

FIG. 4 shows a side view cross-section taken along line A—A in FIG. 3 illustrating the connection of the ends of the conductive traces 36 to the electrodes 40 formed on the substrate 28. A portion 42 of the barrier layer 30 is used to insulate the leads 37 of the conductive traces 36 from the substrate 28. Also shown is a side view of the flexible circuit 18, the barrier layer 30, the windows 22 and 24, and the entrances of the ink vaporization chambers 32. Droplets of ink 100 are shown being ejected from orifice holes associated with each of the ink vaporization chambers 32.

Figure 5:
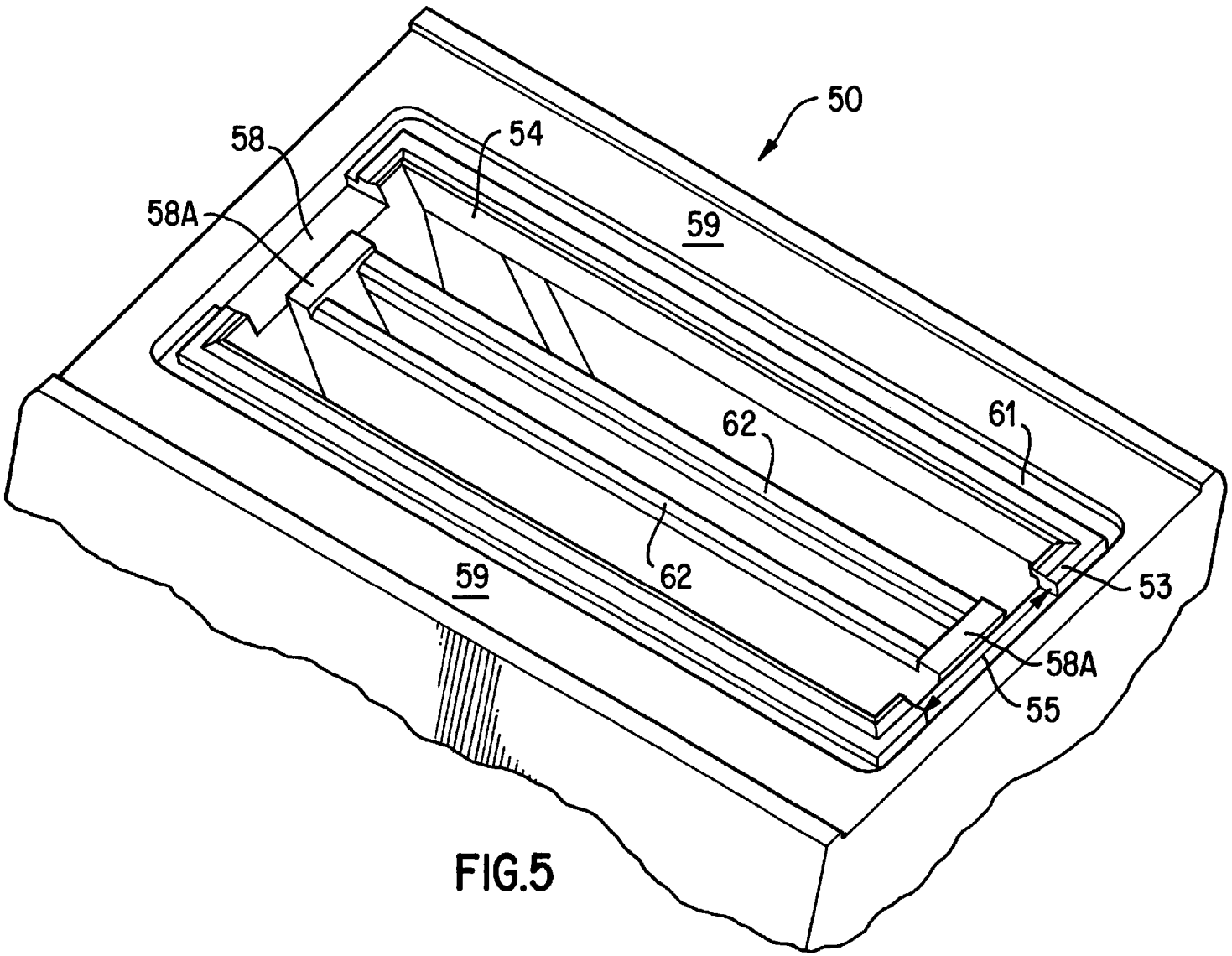
FIG. 5 is a perspective view of the headland area of the inkjet print cartridge of FIG. 1.
Figure 6:
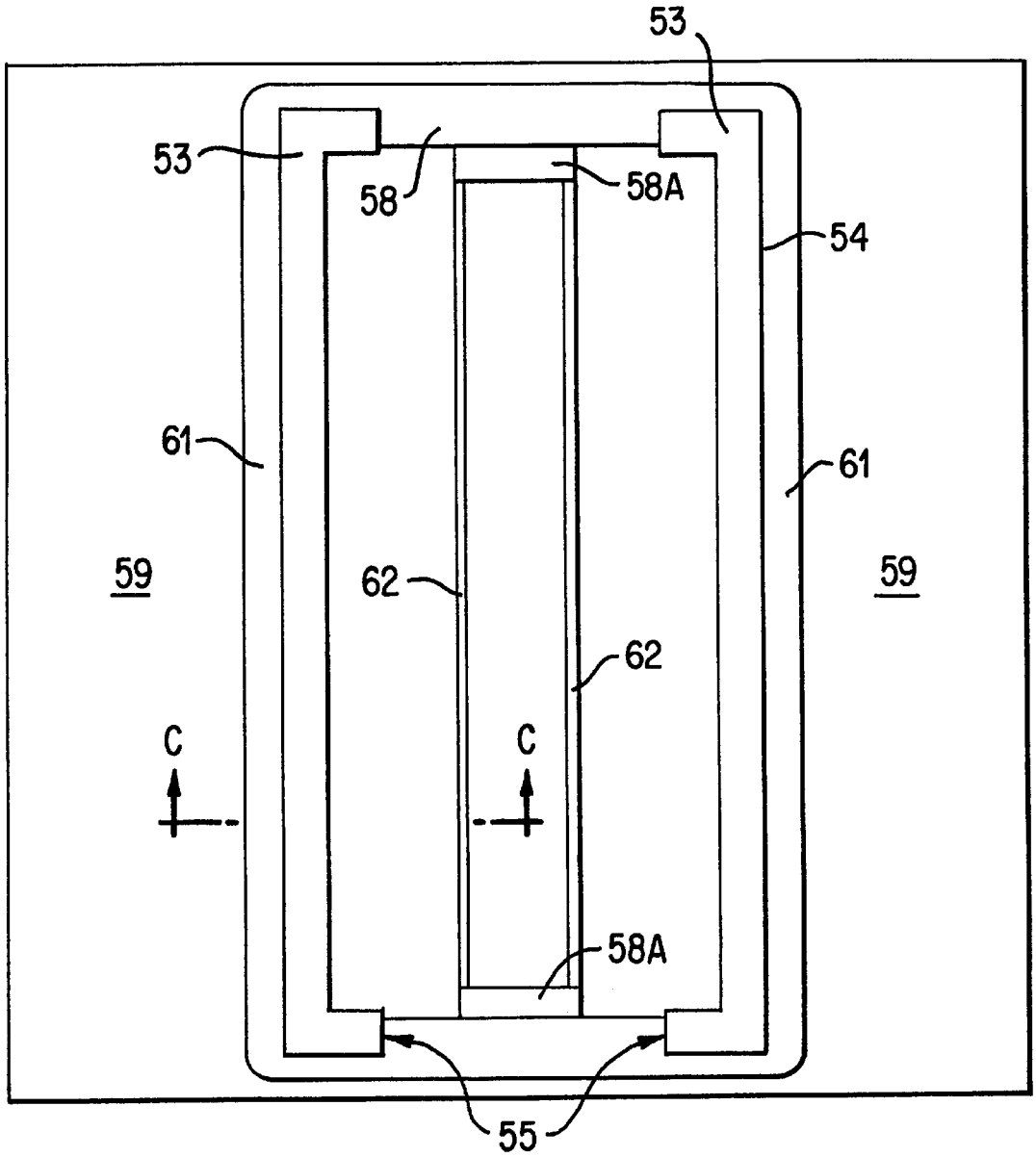
FIG. 6 is a top plan view of the headland area of the inkjet print cartridge of FIG. 1.
Figure 7:
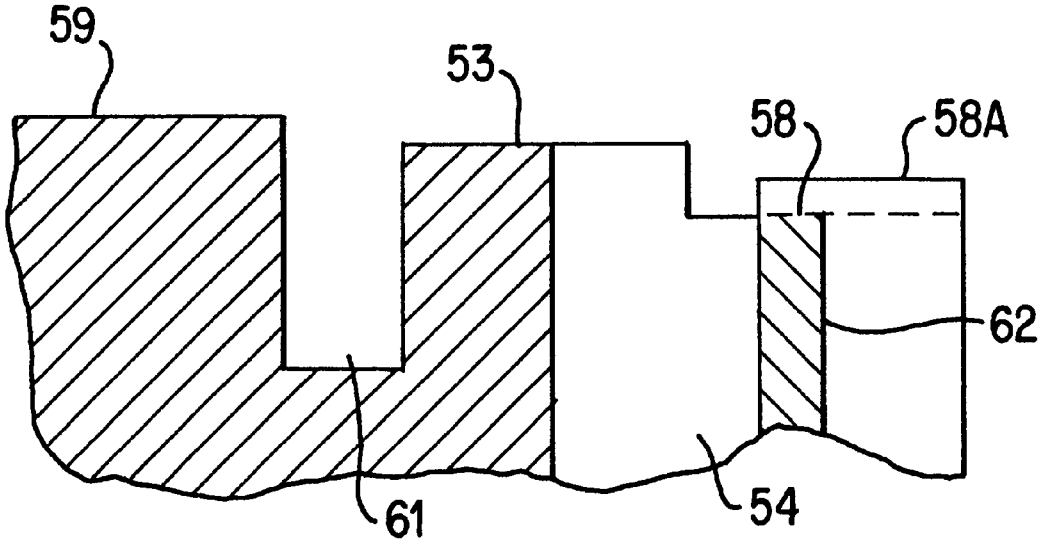
FIG. 7 is a side elevational view in cross-section taken along line C—C in FIG. 6 illustrating the configuration of the adhesive support surface, inner wall, gutter and of the headland design.

FIG. 5 shows the headland area 50 of print cartridge 10 of FIG. 1 in a perspective view and with the TAB head assembly 14 removed to reveal the headland design used in providing a seal between the TAB head assembly 14 and the body of the print cartridge 10. FIG. 6 shows the headland area 50 of FIG. 5 in a top plan view. FIG. 7 shows the headland area 50 in a cross-sectional view along sectional line C—C in FIG. 6.

Shown in FIGS. 5, 6 and 7 are an inner raised wall 54, an adhesive support surface 53 on the inner raised wall, openings 55 in the inner raised wall 54, a surface 58, a raised substrate support surface 58A, a flat top surface 59 and a gutter 61. Also shown are walls 62 which define the ink flow path 88 to the back of the substrate 28.

Figure 8:
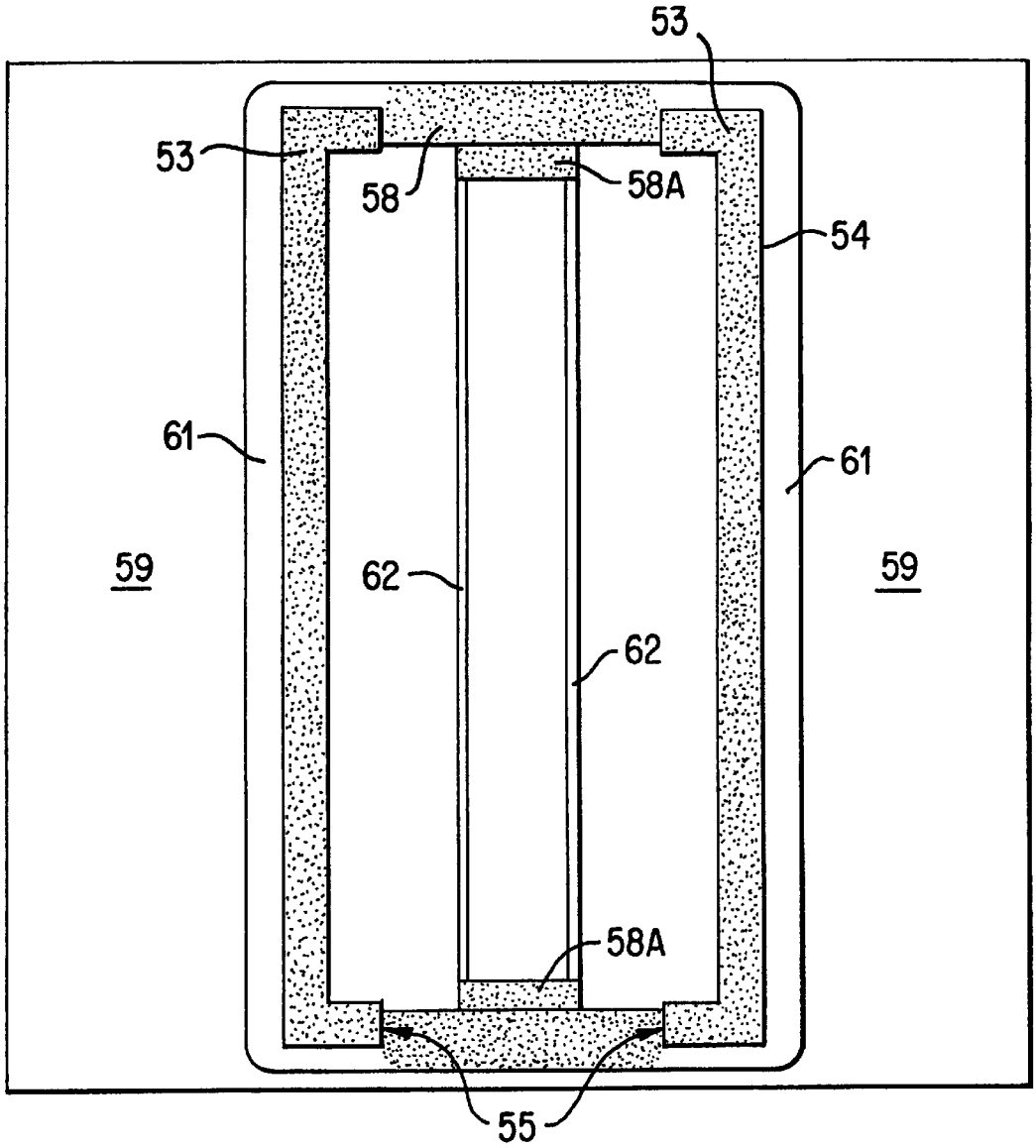
FIG. 8 is a top plan view of the headland area showing generally the location of the adhesive bead prior to placing the TAB head assembly on the headland area.

FIG. 8 is top plan view showing generally the location of the dispensed adhesive 90 along the adhesive support surface 53 of inner raised wall 54, on elevated substrate support surface 58A and across surface 58 in the wall openings 55 of the inner raised wall 54.

The adhesive circumscribes the substrate 28 when the TAB head assembly 14 is properly positioned and pressed down on the headland 50. The adhesive 90 forms a structural attachment between the TAB head assembly 14 and the inner raised wall 54 and the support surface 58 of the print cartridge 10. The adhesive also provides a liquid seal between the above-described circumscribed location and the back of the TAB head assembly 14 when TAB head assembly 14 is affixed to headland.

Figure 9:
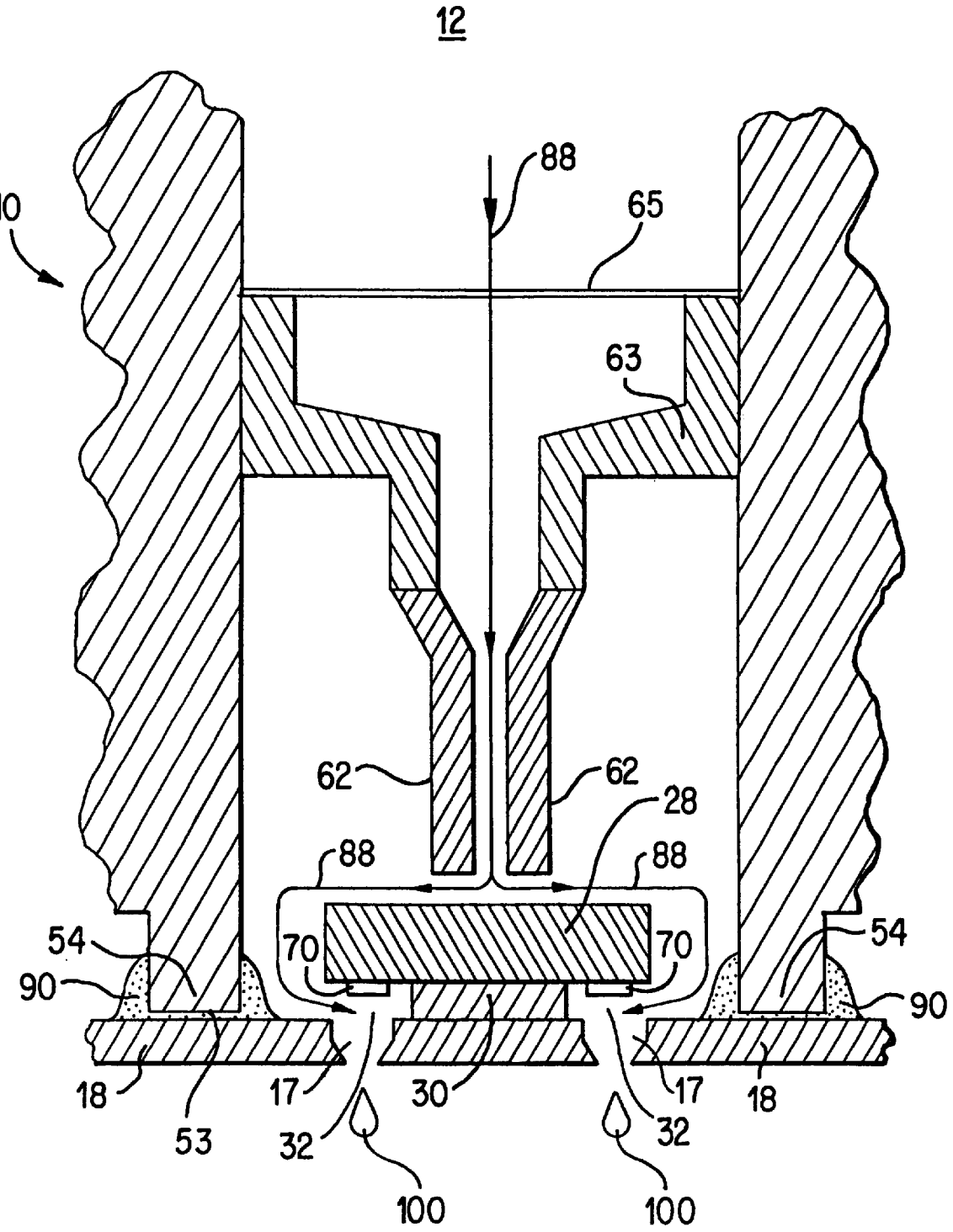
FIG. 9 is a partial schematic cross-sectional schematic view taken along line B—B of FIG. 1 showing portion of the print cartridge in the proximity to the TAB head assembly.

FIG. 9 is a partial cross-sectional schematic view taken along line B—B of FIG. 1 showing vaporization chambers 32, thin film resistors 70, and orifices 17 after the barrier layer 30 and substrate 28 are secured to the back of the flexible circuit 18 and the flexible circuit 18 is secured to the inner raised wall 54 of the print cartridge 10 by adhesive 90. In operation, ink flows from reservoir 12 around the edge of the substrate 28, and into vaporization chamber 32, as shown by the arrow 88. A barrier layer 30, the flexible tape 18 and substrate 28 define the ink vaporization chambers 32. Upon energization of the thin film resistor 70, a thin layer of the adjacent ink is superheated, causing a droplet of ink 100 to be ejected through the orifice 17. The vaporization chamber 32 is then refilled with ink by capillary action. Also shown is a portion of the adhesive seal 90, applied to the inner raised wall 54 surrounding the substrate 28.

The plastic print cartridge 10 body is formed such that an ink conduit directs the flow of ink 88 from an reservoir 12 within the print cartridge 10 towards the back of the substrate 88 and through a narrow gap that exists between the back surface of substrate 28 and the walls 62. The ink 88 then flows along the back surface of substrate 28, around the edge of substrate 28 and into the vaporization chamber 32. The filter carrier 63 and the walls 62 direct the flow of ink 88. The walls 62 of the ink conduit terminate approximately 0.127 mm (5 mils) from the back of the substrate 28, thereby forming the narrow gap. An acceptable range for this gap is from about 3 mils to about 12 mils, depending on the ink viscosity and flow rates. The distance, in the preferred embodiment, between walls 62 is approximately 1 mm. The distance between walls 62 may be anywhere between about 1 mm and 5 mm. Other distances may also be suitable depending upon the size of substrate 88, ink viscosity, and flow rates. The thickness of walls 62 is about 0.5 mm, but thinner or thicker walls will also work.

Figure 10:
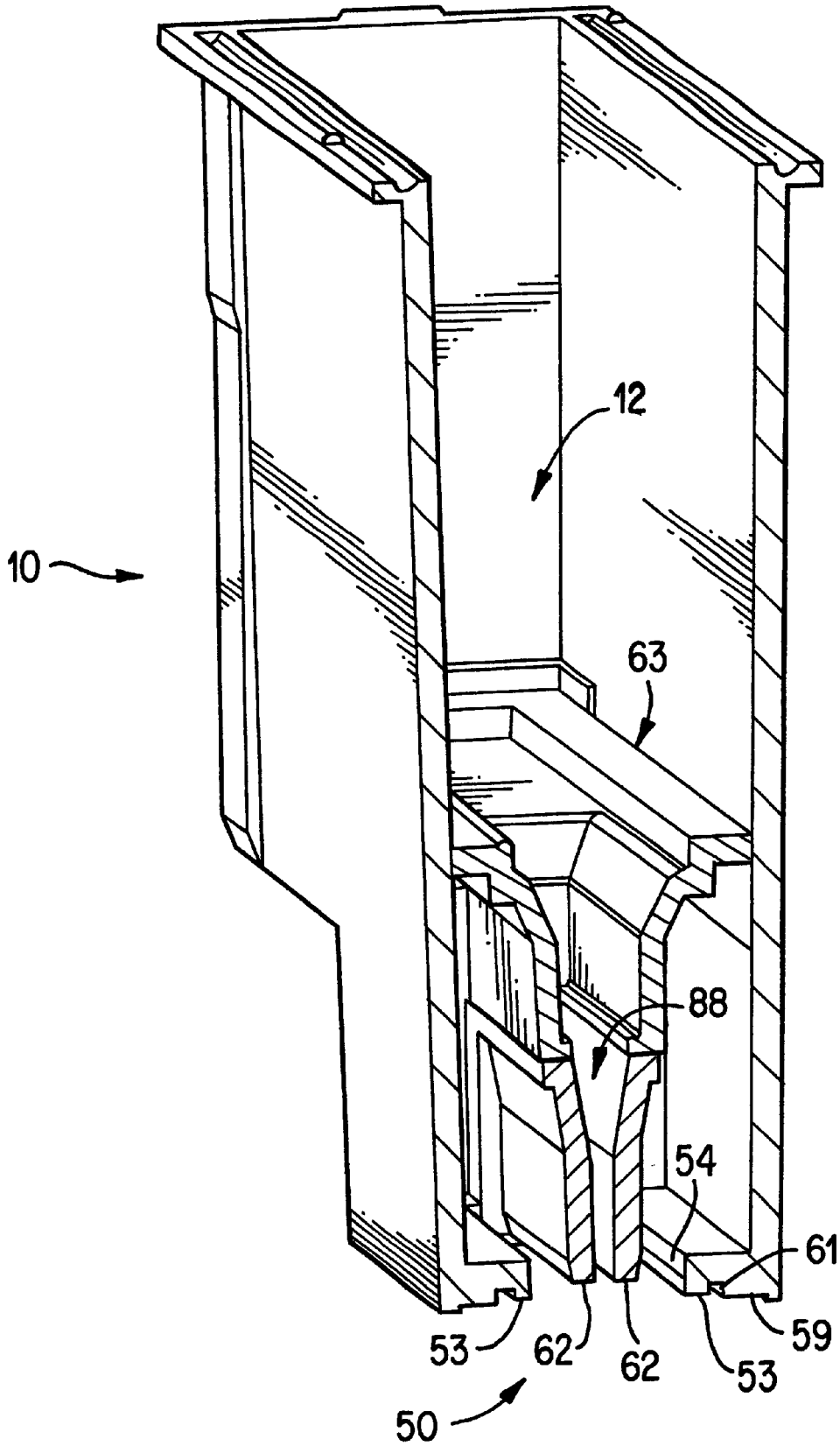
FIG. 10 is a cross-sectional, perspective view along line B—B of FIG. 1 with the TAB head assembly removed illustrating the internal structure of a inkjet print cartridge and the headland 50 area.

FIG. 10 is a cross-sectional, perspective view along line B—B of FIG. 1 with the flexible circuit 18 removed illustrating the internal structure of a inkjet print cartridge and the headland area 50. Illustrated is an ink reservoir region 12 for containing ink, a filter carrier 63 with its filter screen 65 removed, walls 62, the ink flow path 88 defined by the filter carrier 63 and walls 62 leading to the back surface of the substrate 28. Also shown is a portion of the headland area 50 including inner raised wall 54, adhesive support surface 53 on the inner raised wall, flat top surface 59 and gutter 61.

Prior headland designs have not adequately addressed the problem of "ink shorts" occurring near the leads 37 of the flexible circuit 18 of TAB head assembly 14 due to ink penetrating the flex circuit 18 in the region of the leads 37. These ink shorts cause malfunctioning of the printhead and shorten the life of the print cartridge.

Figure 11:
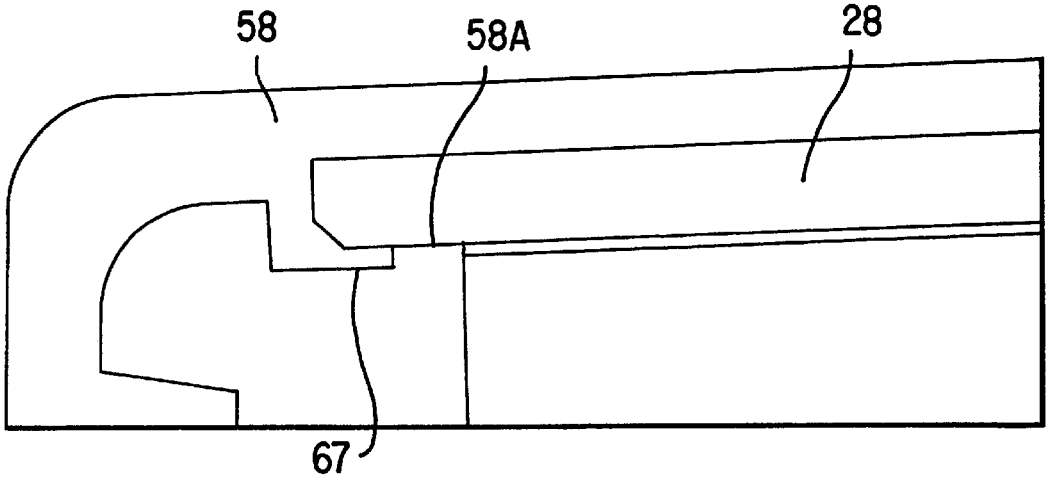
FIG. 11 is a partial cross-sectional view along line D—D of FIG. 1 illustrating the support of the substrate in the headland area. of the print cartridge.

FIG. 11 is a partial cross-sectional view along line D—D of FIG. 1 illustrating the support of the substrate in the headland area 50 of the print cartridge 10 by elevated substrate support surface 58A before the addition of the adhesive 90. By moving the substrate support surface 58A further inboard, off the ends of the substrate 28, the space 67 around the ends of the substrate 28 is open to be filled with the structural adhesive 90 that provides the ink seal. In this manner, the minimum adhesive thickness at the substrate 28 ends can be increased from essentially zero to a more optimal value of approximately between $5\mu$ and 1 mm at the ends of the substrate 28.

As the TAB head assembly 14 is pressed down onto the headland 50, the adhesive is squished down. The adhesive squishes through the wall openings 55 in the inner raised wall to encapsulate the traces leading to electrodes on the substrate. The adhesive also squishes up through the windows 22, 24 and flush with the top surface of the windows.

From the adhesive surface 53 of the inner raised walls 54, the adhesive overspills inwardly and outwardly into the gutter 61 between the inner raised walls 54 and the outer raised wall 60 which blocks further outward displacement of the adhesive. From the wall openings 55 in the inner raised wall, the adhesive squishes both inwardly and upwardly through windows 22, 24.

This seal formed by the adhesive 90 circumscribing the substrate 28 allows ink to flow around the sides of the substrate 28 to the vaporization chambers 32 formed in the barrier layer 30, but will prevent ink from seeping out from under the TAB head assembly 14. Thus, this adhesive seal 90 provides a strong mechanical coupling of the TAB head assembly 14 to the print cartridge 10, a fluidic seal and flexible circuit lead encapsulation. The displacement of the adhesive not only serves as an ink seal, but encapsulates the conductive traces in the vicinity of the windows 22, 24 from underneath to protect the conductive traces from ink.

Figure 12:
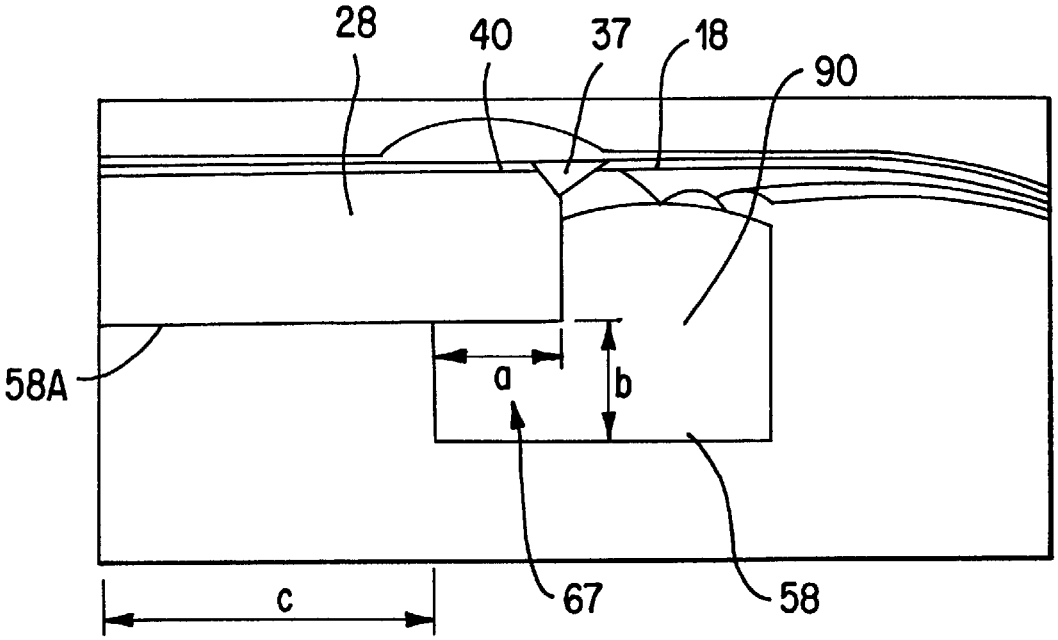
FIG. 12 is a cross-sectional view taken along line E—E of FIG. 1 showing the adhesive encapsulating the substrate.

FIG. 12 is a cross-sectional view taken along line E—E of FIG. 1 showing the adhesive 90 filling the region 67 between the bottom of the substrate 28 and the surface 58 after assembly. In designs which do not incorporate the present invention, the adhesive thickness under the ends of the substrate 28 is squeezed to a minimal thickness of as substrate 28 is pressed against the surface 58 during assembly. Therefore, this adhesive thickness in the substrate area provides minimal protection against ink penetration. As shown in FIG. 12, the adhesive thickness, b, between the bottom of the substrate 28 and the surface 58 may be varied by adjusting the height of elevated substrate support surface 58A. Generally this adhesive thickness is approximately 5 to 400 microns. The length of the encapsulation of the substrate ends is determined by the dimension a in FIG. 12. Generally this distance is approximately 0 to 150 microns. Also shown is the length, c, of the elevated substrate support surface 58A. Generally, this distance is approximately 5 to 250 microns.

The advantages of the present invention have been demonstrated experimentally for two different print cartridge designs with and without the use of the present invention. Print cartridges of both designs were built with and without the use of the present invention. Accelerated storage testing at 60 degrees C for two weeks showed a significant decrease in ink penetration under the ends of the substrate 28 when the present invention was employed in either of the print cartridge designs.

Specifically, with the first print cartridge design, experimental results showed significant improvement in reducing ink penetration between substrate and structural adhesive. Results showed that approximately five percent of the print cartridges using the present invention exhibited ink penetration whereas, approximately sixty percent of the print cartridges not incorporating the present invention exhibited ink penetration.

Additionally, a second print cartridge design showed similar results when using the present invention. Experimental results from this second print cartridge design also showed significant improvement in reducing ink penetration between substrate and structural adhesive. Results showed that approximately five percent of the print cartridges using the present invention exhibited ink penetration whereas, approximately eighty-five percent of the print cartridges not incorporating the present invention exhibited ink penetration. Thus, ink penetration from print cartridges identical except for the present invention had much higher ink penetration.

The present invention provides increased encapsulation of the flexible circuit leads and traces that extend from the cover layer edge to the substrate edge. The design and process of the present invention uses a raised substrate support surface to provide increased encapsulation of the flexible leads by the adhesive used to secure the flexible circuit to the print cartridge body. By providing this increased encapsulation of the flexible circuit leads, corrosion and electrical shorting are greatly reduced in this region. Also, the process and design for flexible circuit lead encapsulation of the present invention produces far fewer air pockets because access to the flexible circuit leads is increased by use of a raised substrate support surface.

The present invention improves the robustness of the print cartridge against electrical shorts caused by ink penetrating the electrical leads of the shorting failure mode.

This provides tangible benefits both in increased manufacturing yields and long-life reliability for the end-user of the print cartridge.

An advantage of the invention that the invention can be implemented through only a change to the molded body of the print cartridge. Accordingly, unlike other potential solutions, no changes are required at the substrate or TAB head assembly level. Moreover, no manufacturing process changes are required. Finally, the present invention extends the life of the print cartridge.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printer that are of the thermal type Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A print cartridge for an inkjet printer comprising:

a flexible circuit having a nozzle member formed therein, said nozzle member including a plurality of ink orifices and the flexible circuit having electrical leads;

a substrate containing a plurality of heating elements and associated ink vaporization chambers, said substrate having electrodes to which the electrical leads are bonded, said substrate mounted on a back surface of said nozzle member, each heating element being located proximate to an associated ink orifice, said back surface of said nozzle member extending over two or more outer edges of said substrate;

a print cartridge body having a headland portion located proximate to the back surface of said nozzle member and including an inner raised wall circumscribing the substrate, the inner raised wall having wall openings therein, said wall openings having a support surface; and an elevated substrate support surface raised above said support surface for supporting the substrate;

an adhesive layer between the back surface of said nozzle member and the headland to affix said nozzle member to said headland, said adhesive layer located on the inner raised wall and along the support surface within the wall openings therein and on the elevated substrate support surface, so as to encapsulate the ends of the substrate.

2. The ink cartridge of claim 1 wherein the elevated substrate support surface is approximately between 5 and 400 microns above the support surface.

3. The ink cartridge of claim 1 wherein the elevated substrate support surface is approximately between 5 and 200 microns above the support surface.

4. The ink cartridge of claim 1 wherein the elevated substrate support surface is located a distance of approximately 0 to 150 microns from the end of the substrate.

5. The ink cartridge of claim 1 wherein the elevated substrate support surface is located 0 to 100 microns from the end of the substrate.

6. The ink cartridge of claim 1 wherein said substrate is in fluidic communication with an ink reservoir body.

7. The ink cartridge of claim 1 wherein said nozzle member is formed of a flexible polymer material.

8. The ink cartridge of claim 1 wherein said adhesive layer also forms a fluidic seal between said headland and the back surface of said nozzle member.

9. A method of assembling a print cartridge comprising:

providing a flexible circuit having a nozzle member formed therein, said nozzle member including a plurality of ink orifices and the flexible circuit having electrical leads, said flexible circuit having a substrate mounted on a back surface of said nozzle member, said substrate having a plurality of heating elements and associated ink vaporization chambers, said substrate having electrodes to which the electrical leads are bonded, each heating element being located proximate to an associated ink orifice, said back surface of said nozzle member extending over two or more outer edges of said substrate;

providing a print cartridge body having a headland portion located proximate to the back surface of said nozzle member and including an inner raised wall circumscribing the substrate and having wall openings therein, said wall openings having a support surface and an elevated substrate support surface raised above said support surface for supporting the substrate;

dispensing an adhesive layer between the back surface of said nozzle member and the headland to affix said nozzle member to said headland, said adhesive layer located on the inner raised walls along the support surface within the wall openings and on the elevated substrate support surface; and positioning the back surface of the nozzle member with respect to the headland such that the adhesive circumscribes the substrate and affixes the back surface of the nozzle member to the headland so as to encapsulate the ends of the substrate with the adhesive.

10. The ink cartridge of claim 9 wherein the elevated substrate support surface is approximately between 5 and 400 microns above the support surface.

11. The ink cartridge of claim 9 wherein the elevated substrate support surface is approximately between 5 and 200 microns above the support surface.

12. The ink cartridge of claim 9 wherein the elevated substrate support surface is located a distance of approximately 0 to 150 microns from the end of the substrate.

13. The ink cartridge of claim 9 wherein the elevated substrate support surface is located 0 to 100 microns from the end of the substrate.

14. The method of claim 9 wherein in said providing step the substrate is in fluidic communication with an ink reservoir body.

15. The method of claim 9 wherein in said affixing step said nozzle member is formed of a flexible polymer material.

* * * * *